United States Patent [19]

Baer

[11] Patent Number: 4,578,837

[45] Date of Patent: Apr. 1, 1986

[54] APPARATUS FOR CLEANING TEE FORMS

[75] Inventor: Edward P. Baer, Fort Worth, Tex.

[73] Assignee: Hamilton Equipment Company, Inc., Fort Worth, Tex.

[21] Appl. No.: 660,419

[22] Filed: Oct. 12, 1984

[51] Int. Cl.[4] ..... A46B 13/02

[52] U.S. Cl. ..... 15/21 R; 15/21 E; 15/49 C; 15/56; 15/181; 15/DIG. 6

[58] Field of Search ..... 15/21 D, 21 E, 56, 179, 15/181, 49 C, 50 C, 53 A, 53 AB, DIG. 6, 21 R

[56] References Cited

U.S. PATENT DOCUMENTS

| | | | |
|---|---|---|---|
| 2,613,383 | 10/1952 | Rousseau | 15/181 |
| 3,407,425 | 10/1968 | Drumm | 15/181 |
| 3,479,678 | 11/1969 | Jeffreys | 15/21 E |
| 3,562,832 | 2/1971 | Rickard | 15/56 |
| 3,839,763 | 10/1974 | Gould | 15/181 |
| 3,992,745 | 11/1976 | Laurila | 15/56 |

FOREIGN PATENT DOCUMENTS

| | | | |
|---|---|---|---|
| 1572804 | 8/1980 | United Kingdom | 15/DIG. 6 |

OTHER PUBLICATIONS

Martin Concrete Engineering Company Brochure (1976) for "Stemwinder" machine.

*Primary Examiner*—Edward L. Roberts

*Attorney, Agent, or Firm*—Richards, Harris, Medlock & Andrews

[57] ABSTRACT

A cleaning apparatus (10) is disclosed for cleaning the leg sections (16) of forms such as a double leg form (12). A plurality of individual cleaning brushes (76) are positioned along the length of a brush shaft (64). The brush shaft (64) and cleaning brushes (76) are rotated and the cleaning brushes (76) are urged against the sloping sides (24) of the leg section (16) to clean the sides. As the brushes wear, they can be moved along the shaft in the direction where the sides slope together to obtain maximum use from the brushes. When a brush has become too worn to be effective, it is removed from the section of the brush shaft adjacent the end plate (84). Replacement brushes can be added to the brush shaft adjacent the locking nut (88).

14 Claims, 8 Drawing Figures

FIG. 2
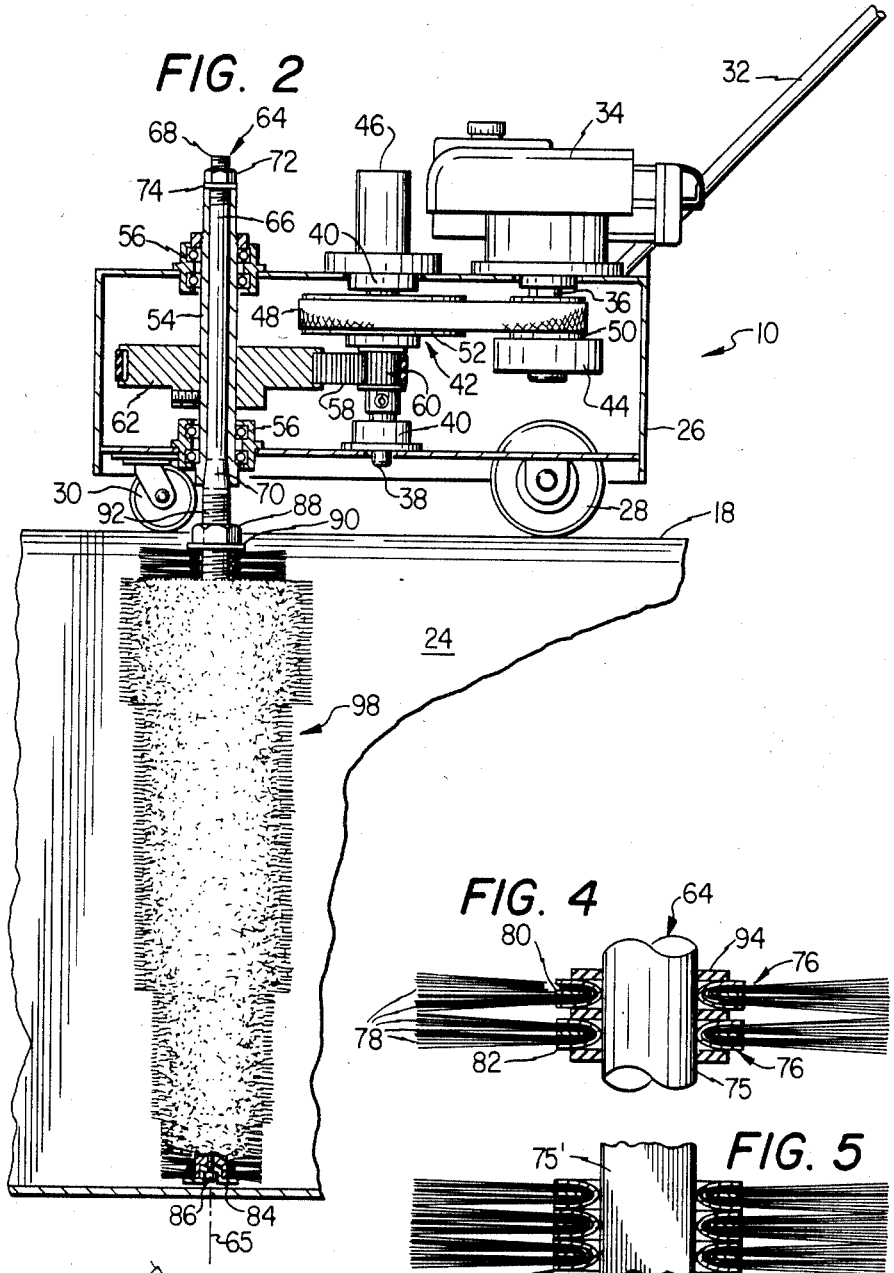
FIG. 4
FIG. 5
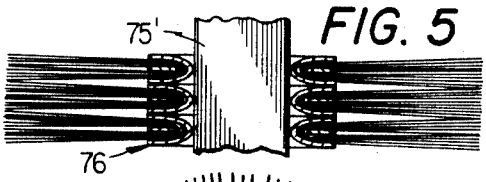
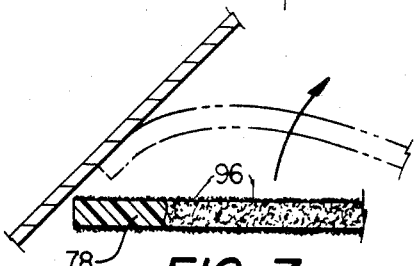
FIG. 7
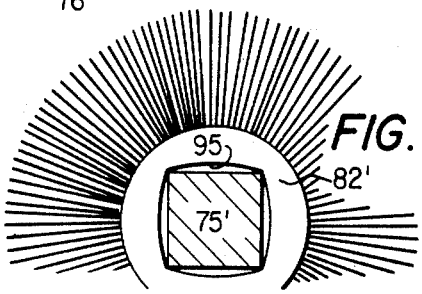
FIG. 6

APPARATUS FOR CLEANING TEE FORMS

TECHNICAL FIELD

This invention relates to the cleaning of molds, particularly the cleaning of a leg section having sloped sides in a concrete mold.

BACKGROUND OF THE INVENTION

Precast and prestressed concrete structural sections can be formed by pouring concrete into a form which will mold the concrete into the desired shape. A common application of this technology is in the formation of floor and roof sections for car parking garages and other buildings which include a horizontal deck portion with downwardly extending leg or stem sections to add strength to the molded concrete. A common form used for molding the concrete into this shape is a double leg form which is normally constructed of steel.

The conventional double leg form has a horizontal surface for forming the top of the section of the molded concrete, commonly called the deck, and downwardly and inwardly sloped surfaces for forming the leg sections of the molded concrete. The leg section of the double leg form must generally slope downwardly and inwardly to permit ready release of the molded concrete upon hardening. A common slope for the leg section of the double leg form is one in twenty-two. However, many other slopes are used.

In repeated molding using any concrete form, the ability to clean the form after use to prepare it for the next mold is highly critical. After the molded concrete is removed from the form, particulate matter, such as concrete particles and dust, and chemicals such as release agents, remain on the form surface and must be removed before concrete is again poured into the mold. Generally, the horizontal surfaces of the form can be readily cleaned, including the portion forming the deck section of the molded concrete and the bottom of the leg sections of the form. However, the sloped sides of the leg section of the form are quite difficult to clean.

The industry has attempted to develop apparatus for cleaning the sloped sides of a leg section form. U.S. Pat. No. 3,562,832, issued to Rickard on Feb. 16, 1971, illustrates one example of such an attempt. This patent discloses the use of horizontal brushes for cleaning the horizontal surfaces of a leg form and conical leg brushes which attempt to clean the sloping sides of the leg sections of the form. It can be readily understood that as the conical leg brushes wear, their cleaning action against the sloped sides of the leg section of the form becomes less effective. The Rickard patent discloses the use of adjustable height wheels on the machine driving the brushes which function to actually lower the apparatus and brushes to compensate for wear of the brush elements. However, wear on the leg brushes and horizontal brushes will not be equal. Therefore, adjustment of the wheels to move the entire apparatus downward will not adjust out the differential wear. Because the drive shafts of the Rickard device (both the horizontal brush drive shafts and leg brush drive shafts) are mechanically connected, it would be impractical to adjust the brushes independently. In addition, only limited movement of the machine is permitted and the entire brush must be disposed of once the limit of movement of the adjustable wheels is used up.

Several other shortcomings are present in the Rickard device. The mechanical linkage between the horizontal and leg brush drive shafts makes it difficult to change brush size and brush shape to clean other form shapes with different slopes, widths and depths in the leg section. Also, with its multiple brushes and complex linkage, the Rickard device is relatively large, heavy and expensive. It would probably require a crane to pick it up for movement to another form. The Rickard device also devotes too much attention and resources to cleaning the deck, when the most difficult parts to clean are the tee sections. Finally, longer forms, commonly called "long line" forms, are generally not perfectly straight. The leg surfaces and top outside edge rails may well be nonparallel. The Rickard device does not appear to have any ability to adjust the spacing of the leg brushes relative to the horizontal brushes. Therefore, as the device travels along the form, the pressure exerted on the leg surfaces by the leg brushes may vary and the leg brushes may even lose contact with a surface on the leg, resulting in poor and nonuniform cleaning.

A need therefore exists for an apparatus for effectively cleaning the sloped sides of a leg section of a form which overcomes the disadvantages of the prior device disclosed in U.S. Pat. No. 3,562,832. The apparatus should be able to follow the leg surfaces while maintaining equal cleaning pressure against the surfaces. The improved device should provide economical cleaning with a minimum of maintenance, service and adjustment by the operator.

SUMMARY OF THE INVENTION

In accordance with one aspect of the present invention, a cleaning apparatus for cleaning a surface of a form is provided. The cleaning apparatus includes a frame and a brush shaft mounted for rotation on the frame. Means are mounted on the frame for rotating the brush shaft. A plurality of brushes are positioned along the brush shaft for rotation with the brush shaft to clean the surface of the form. The brushes are individually removable and replaceable as they wear.

In accordance with another aspect of the present invention, a cleaning apparatus is provided for cleaning the sloping sides of a form, the sides sloping toward each other in the first direction. The apparatus includes a frame and a brush shaft rotatably mounted on the frame for extending along the sides to be cleaned. Means are provided which are mounted on the frame for rotating the brush shaft. A plurality of brushes are spaced along a portion of the brush shaft and are secured to the brush shaft for rotation therewith. The brushes are urged against the sloping sides of the form as the brush shaft is rotated to clean the sloping sides. Each of the brushes is movable in the first direction relative to the sloping sides as the brush wears to permit the worn brush to maintain effective cleaning contact with the sloping sides. Thus, only replacement of sufficient brushes to maintain an effective cleaning contact along the sloping sides is required.

In accordance with yet another aspect of the present invention, a method of cleaning a surface of a form is provided. The method includes the steps of positioning a plurality of cleaning brushes along a brush shaft and securing the brushes on the brush shaft for rotation therewith. The method further includes the step of urging the brushes against the surface to be cleaned and rotating the brushes and brush shaft to clean the surface. The worn brushes are moved along the brush shaft and brushes are replaced as required to maintain effective cleaning of the surface.

BRIEF DESCRIPTION OF THE DRAWINGS

A more complete understanding of the invention may be had by reference to the following detailed description when taken in conjunction with the accompanying drawings, wherein:

FIG. 2 is a side view of the double leg form and cleaning apparatus in partial cross section illustrating the brush shaft and brushes;

FIG. 4 is a partial cross section of the brush shaft and brushes used in the cleaning apparatus;

FIG. 5 is a partial cross section of a first modification of the brush shaft and brushes in the cleaning apparatus;

FIG. 6 is a section view of the brush shaft and brushes of the first modification shown in FIG. 5;

FIG. 7 is an illustrative view of the cleaning action of the nylon bristles in each brush with a silicone carbide coating.

DETAILED DESCRIPTION

Figure 1:
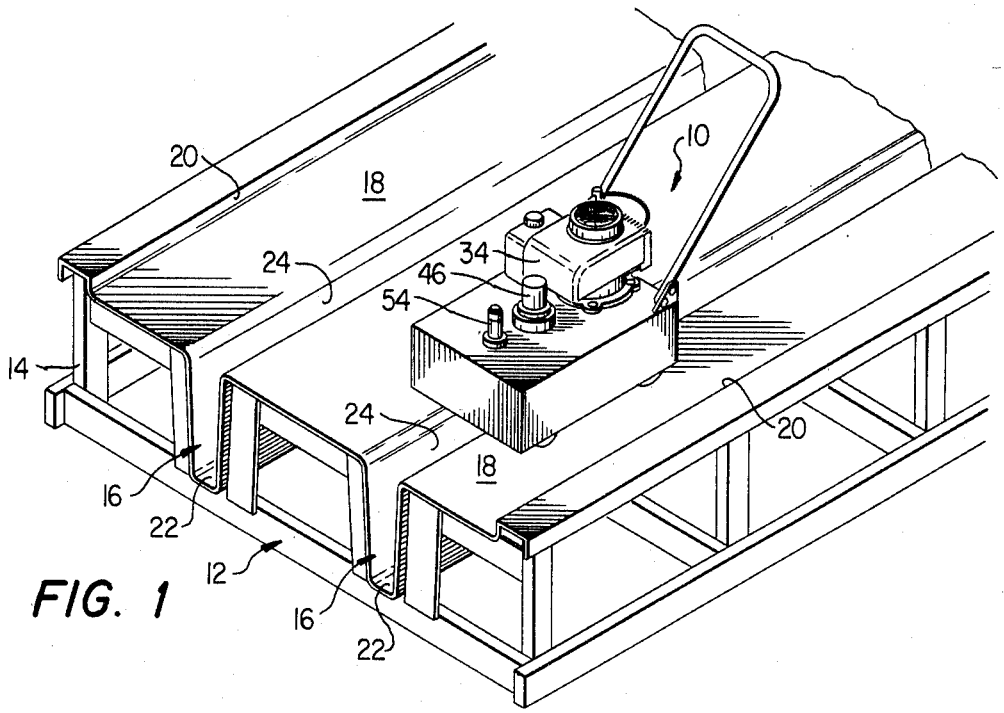
FIG. 1 is a perspective view of a portion of a double leg form with a cleaning apparatus forming one embodiment of the present invention positioned on the form for cleaning a leg section.

Referring now to the drawings, wherein like reference characters designate like or corresponding parts throughout several views, FIG. 1 illustrates a cleaning apparatus 10 for use in cleaning portions of a double leg form 12. The double leg form is used for molding concrete into a shape such as found in the floors and roofs of buildings and highway bridge construction, and the form can be 250 to 500 feet in length. The molded concrete includes a flat or top section and two downwardly extending leg sections which extend along the length of the top section to add strength. During molding, the end 14 of form 12 shown in FIG. 1 is closed off by an internal vertical wall, commonly called a bulkhead or header, as is the other end of the form, not shown. These bulkheads are also placed in the form where needed to dam the concrete and produce molded sections of a desired length, often allowing multiple sections to be cast in a single pour in the form. Concrete can then be poured into the mold, filling the two leg sections 16 and spreading over the horizontal sections 18 up to the lip 20 of the mold. It can be seen that the molded concrete will be formed into a double leg shape, suitable for use in construction, such as a highway bridge or building floor or roof. Typically, reinforcing steel will be placed in the mold before pouring concrete so that the reinforcing steel is molded into the concrete to increase the strength of the molded product.

After the concrete has been molded, it can be lifted from the mold and transported to its final destination. Prior to pouring the next mold, however, the form 12 must be thoroughly cleaned to remove concrete debris and chemicals, such as release agents, from the surfaces of the form. The horizontal sections 18 can be readily cleaned because of their planer and horizontal configuration. In addition, the horizontal bottoms 22 of the leg sections 16 can be readily cleaned as they also are planer. However, the sloping sides 24 of the leg sections 16 are more difficult to clean as they slope downwardly and inwardly to the horizontal bottom 22. In addition, the length of the forms, typically 250 to 500 feet, makes the cleaning of this narrow area additionally difficult. In one typical application, the slope of sides 24 is a ratio of one to twenty-two. In other words, the separation between facing sides 24 may decrease from five and three-quarter inches at the top of the leg section to three and three-quarter inches at the bottom of the leg section for a leg depth of twenty-two inches, measured from a plane parallel the horizontal sections 18 and extending vertically downward to the horizontal bottom 22. However, this slope and these dimensions are only examples of the many varied sizes encountered (i.e., leg section depth and width and resulting slopes). The presence of so many diverse slopes makes the ability to quickly and cheaply change brushes a vital factor.

Figure 3:
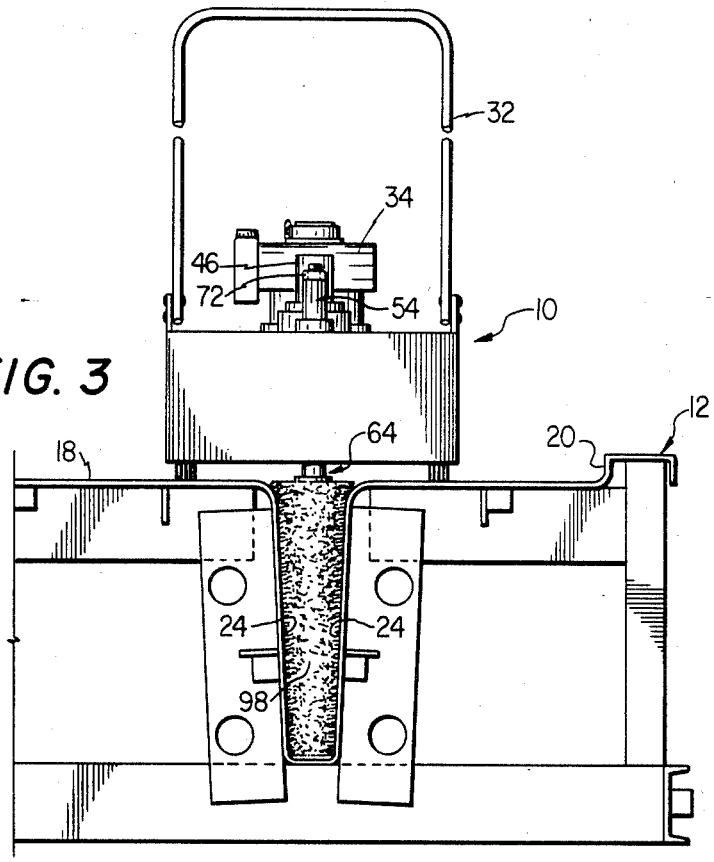
FIG. 3 is an end view of a portion of the double leg form and the cleaning apparatus.

The cleaning apparatus 10 is particularly effective for cleaning sloping sides 24 as best seen in FIGS. 2 and 3. In addition, the cleaning apparatus 10 has the advantage of employing a plurality of individual brush elements which can be moved downwardly along the brush shaft as they wear to maintain an effective cleaning action. It is therefore only necessary to replace completely worn brush elements proximate the bottom 22 and replace them with fresh brush elements at the level parallel the horizontal sections 18, simply sliding the already mounted brush elements downwardly on the brush shaft.

The cleaning apparatus 10 includes a frame 26 which is mounted on a pair of rear nonpivotal wheels 28 and a pair of front pivotal wheels 30. A handle 32 extends from the frame 26 for grasping by the operator, much like the common lawn mower handle.

A conventional internal combustion engine 34 is mounted near the rear of the frame 26 and has a drive shaft 36. In one unit constructed in accordance with the teachings of the present invention, the engine 34 was an eight horsepower four cycle Briggs and Stratton engine.

An intermediate shaft 38 is rotatably mounted on the frame 26 by bearings 40 for rotation about an axis parallel the rotational axis of the drive shaft 36. The drive shaft 36 and intermediate shaft 38 are connected through a torque converter assembly 42 so that the engine rotates shaft 38. The torque converter assembly 42 prevents the intermediate shaft 38 from being rotated by drive shaft 36 when the rotational speed of the drive shaft is below a predetermined speed, commonly the idle speed of the engine 34. The torque converter assembly 42 also varies the speed ratio of rotation between the drive shaft 36 and intermediate shaft 38 to obtain the transference of maximum power from the engine 34 to shaft 38. In the unit constructed in accordance with the teachings of the present invention, the torque converter assembly 42 was formed by a torque converter system available from Comet Industries of 358 Northwest F Street, Richmond, Ind. 47374, and included a drive clutch 44 mounted for rotation with the drive shaft 36, a driven unit 46 mounted for rotation with the intermediate shaft 38 and a cogged drive belt 48. The drive clutch 44 has a centrifugally operated clutch which acts between the drive shaft 36 and the pulley 50 about which the drive belt 48 fastens. Below a predetermined rotational speed of drive shaft 36, the clutch is disengaged and the pulley 50 and drive belt 48 will not be rotated. Above the predetermined rotational speed, the clutch engages and the pulley 50 and drive belt 48 are driven by the drive shaft 36. Both the drive clutch 44 and driven unit 46 have centrifugally operated mechanisms which vary the distance between the sloped faces of the pulley 50 on drive clutch 44 and pulley 52 on driven unit 46 on which drive belt 48 rides. Generally, the pulley faces on pulley 50 draw closer together as the rotational velocity of drive shaft 36 increases while the pulley surfaces of pulley 52 separate to provide a continuously changing drive ratio between pulleys 50 and 52 to maximize the effectiveness of the engine 34.

A hollow shaft 54 is also mounted for rotation on the frame 26 by roller bearings 56. The axis of rotation 65 of hollow shaft 54 is again parallel to the rotational axes of drive shaft 36 and intermediate shaft 38. The hollow shaft 54 is rotated by the intermediate shaft 38 by a drive belt 58 positioned about drive gear 60 on intermediate shaft 38 and driven gear 62 on hollow shaft 54.

A brush shaft 64 passes through the hollow core of the shaft 54 and is secured thereto for rotation about the axis 65 also. The brush shaft includes a reduced diameter portion 66 which extends through the hollow shaft 54 and ends with a threaded end 68. At the opposite end of the portion 66 is outwardly directed conical wedge portion 70. The brush shaft 64 is secured to the hollow shaft 54 by threading nut 72 with washer 74 on the threaded end 68 and wedging the conical wedge portion 70 against the lower opening of the hollow shaft 54 so that the brush shaft 64 rotates with the hollow shaft 54.

Brush shaft 64 forms a mount for a plurality of individual cleaning brushes 76 which have a disc-like appearance as best seen in FIGS. 4, 5 and 6. The individual brushes are formed by bristles 78 which are folded at their middle about an annular piece 80. The bristles are secured against the annular piece 80 by a hub 82 which compresses the bristles between the annular piece 80 and the sides of the hub 82. In the embodiment illustrated in FIGS. 1–4, the cross section of the brush shaft 64 perpendicular the axis 65 is circulâr. The hub 82 has a circular hole formed therethrough so that the brushes can slide along the brush section 75 of the brush shaft 64. The cleaning brushes 76 are compressed between an end plate 84 which is bolted to the end of the brush section 75 by a bolt 86 and a nut 88 and washer 90 with nut 88 being threaded on an elongate threaded section 92 of the section 75. The cleaning brushes 76 are compressed between the nut 88 and end plate 84 sufficiently so that the brushes rotate with the brush shaft 64. To enhance the rotational attachment of the brushes to the brush shaft, annular rubber spacers 94 can be positioned between each of the brushes 76.

In a first modification, shown in FIGS. 5 and 6, the brush shaft 64 includes a brush section 75' having a square cross section. The cleaning brushes 76 have a hub 82' having a square aperture 95 so that the brushes can slide over the brush section 75'. The brush section 75' can therefore rotate the brushes directly through its contact with the hub 82'. Therefore, the brushes need not be as tightly compressed between nut 88 and end plate 84.

In the preferred embodiment, bristles 78 of the cleaning brushes are formed of nylon and have a silicone carbide abrasive coating 96 along its length. A common wire brush is only effective in cleaning if the end of the brush comes in contact with the surface to be cleaned. A silicone carbide impregnated nylon bristle will be effective in cleaning not only if the end of the bristle contacts the surface but also if the side of the bristle contacts the surface as seen in FIG. 7. However, the cleaning apparatus 10 will also be effective by using such other brush materials as may be appropriate, such as wire.

In operation, the cleaning apparatus 10 is positioned on a double leg form 12 to be cleaned with the cleaning brushes 76 in contact with the sloping sides 24 as seen in FIGS. 1–3. When the cleaning brushes 76 are all new and unworn, it is contemplated that several different diameter brushes will be used, such as seen in FIGS. 2 and 3, to form a generally conical brush assembly 98. The conical brush assembly 98 will generally have a slope equivalent to that of the sides 24 to provide the most effective cleaning of the sides 24. The engine is then run to rotate brush shaft 64 and brushes 76 to clean the portions of sides 24 in contact with brushes 76. The apparatus 10 can then be wheeled along the length of form 12 to fully clean each section 16.

A significant advantage of the cleaning apparatus 10 is the mobility of the individual cleaning brushes 76 on the brush shaft 64. As an individual cleaning brush 76 is worn at a given position on the brush shaft so that it no longer provides effective cleaning of the form surfaces in which it comes into contact, the brush can simply be moved down the brush shaft 64 towards the bottom 22 of the leg section 16 where it will again be effective in cleaning the surfaces in which it comes in contact. Naturally, to permit this movement to occur, another brush, preferably the most worn brush immediately adjacent the end plate 84, must be removed from the shaft and discarded while another brush, preferably a new brush, should be added immediately adjacent the nut 88 to continue cleaning the entire height of the leg section 16. As can be readily understood, an individual brush 76 can be used from its original effective diameter to the point where it is no longer effective even where the sloping sides 24 are close together near the bottom 22. Therefore, a much larger percentage of the total cleaning potential of the cleaning brushes 76 is used in the present invention than was possible in the prior art where a single piece conical shaped brush was employed. Therefore, the need to replace brush elements is decreased and the overall cost of the cleaning apparatus is correspondingly decreased. In addition, the ability to place individual cleaning brushes 76 along the brush shaft 64 permits the external shape of the brush assembly 98 to be tailored to the particular form being cleaned if the sides have a non-planar configuration.

Figure 8:
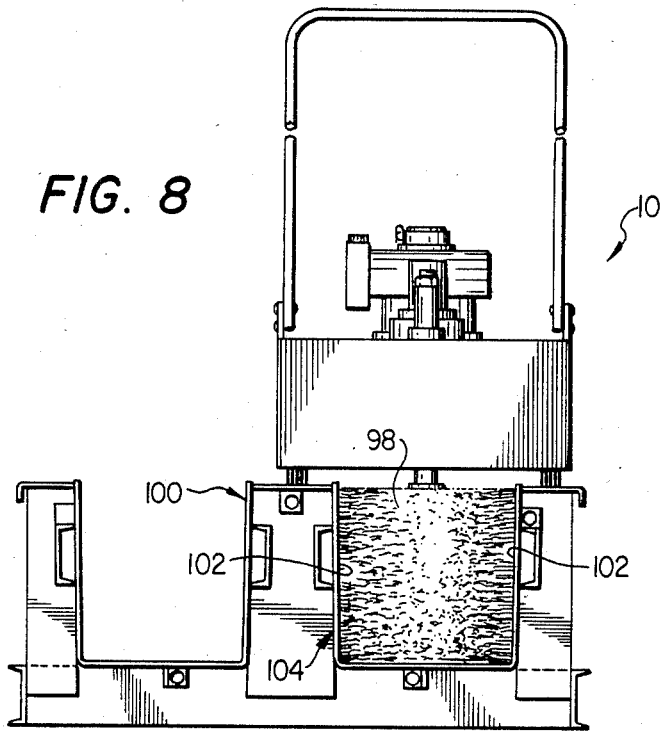
FIG. 8 is an end view of a portion of a square piling form with the cleaning apparatus positioned to clean the sloped sides of the form.

FIG. 8 illustrates another application for the cleaning apparatus 10. A piling form 100 is shown which includes facing sloped sides 102 in leg section 104. Piling forms can also have vertical, non-sloped sides, or sides curved or sloped to form round, octagonal and triangular shapes. The cleaning apparatus 10 can be used with all these shapes, as well as many more, by simply tailoring the diameter of the individual brushes 76 to the particular application.

As can be readily understood, cleaning apparatus 10 has significant advantages over the prior devices. For example, cleaning apparatus 10 is lightweight, portable and economical relative to prior devices. Also, the brush assembly 98 and apparatus 10 will readily follow the contour of the surfaces being cleaned, even when the surfaces are warped.

Although a single embodiment of the invention has been illustrated in the accompanying drawings and described in the foregoing detailed description, it will be understood that the invention is not limited to the embodiment disclosed, but is capable of numerous rearrangements, modifications and substitutions of parts and elements without departing from the spirit of the invention.

I claim:

1. A cleaning apparatus for cleaning a surface of a form including a leg section having sloping sides, comprising:

a frame;

a brush shaft mounted for rotation on said frame;

means mounted on said frame for rotating said brush shaft;

a plurality of brushes positioned along said brush shaft forming a conical brush assembly for rotation with said brush shaft for cleaning the sloping sides of the form, the individual worn brushes being movable along said brush shaft in the direction that the sides of the form slope together so that said worn brushes retain effective cleaning contact with said sloping sides.

2. The cleaning apparatus of claim 1 wherein said brushes include nylon bristles impregnated with silicone carbide abrasive.

3. The cleaning apparatus of claim 1 wherein said brush shaft has a circular cross section and each of said brushes has a hub with a circular aperture for sliding over the brush shaft, said cleaning apparatus further having means mounted on said brush shaft for compressing the brushes along the brush shaft for joint rotation with the brush shaft.

4. The apparatus of claim 1 wherein said brush shaft has a noncircular cross section, said brushes having a hub with an aperture of noncircular cross section adapted for slidable motion over the brush shaft while rotation of said brush shaft acts to rotate said brushes.

5. A cleaning apparatus for cleaning facing sides of a form, the sides being sloped towards each other in a first direction, comprising:

a frame;

a brush shaft rotatably mounted on said frame for extending generally along the sides to be cleaned and generally extending along the first direction;

means mounted on said frame for rotating the brush shaft; and a plurality of brushes spaced along a portion of the brush shaft and secured to the brush shaft for rotation therewith, the brushes generally defining a conical brush assembly being urged against the sides of the form as the brush shaft is rotated to clean the sides, each of said brushes being movable in the first direction along said portion of said brush shaft relative to the sides as the brush wears to permit the worn brush to maintain effective cleaning contact with the sides, thereby requiring only replacement of sufficient brushes to maintain effective cleaning contact between the conical brush assembly and the sides.

6. The cleaning assembly of claim 5 wherein each of said brushes comprises a hub and bristles extending radially outwardly therefrom, said bristles being impregnated with silicone carbide abrasive.

7. The cleaning assembly of claim 6 wherein said portion of said brush shaft mounting the brushes has a noncircular cross section, the hub in each of said brushes having a noncircular aperture to slide along said portion of said brush shaft while insuring common rotation of said brush shaft and brushes.

8. The cleaning assembly of claim 5 wherein said portion of said brush shaft mounting said brushes has a circular cross section, said brush shaft further having an end plate at one end of said portion of said brush shaft and means for compressing said brushes along said portion of said brush shaft against the end plate to insure joint rotation of the brush shaft and brushes.

9. The cleaning assembly of claim 5 wherein said means for rotating the brush shaft includes an engine and a torque converter assembly for transmitting rotation from the engine shaft to the brush shaft.

10. The cleaning apparatus of claim 5 further comprising a hollow shaft mounted on said frame for rotation, said brush shaft having a reduced diameter portion for passing through said hollow shaft, said brush shaft having a wedge surface for wedging against the hollow shaft at one opening therein and means for securing the brush shaft in the wedged position for joint rotation of the hollow shaft and brush shaft.

11. A cleaning apparatus for cleaning facing sides of a form, the sides sloping towards each other in the downward direction, comprising:

a frame mounted on wheels for resting on the form above the sloping sides;

an engine mounted on said frame having a drive shaft extending generally along a first direction;

a hollow shaft mounted for rotation about a second axis parallel to, but spaced from, the first axis;

transmission means for interconnecting the engine drive shaft and hollow shaft for joint rotation;

a brush shaft, said brush shaft having a first section and a second section, said first section having a reduced diameter portion for passing through the hollow shaft and a wedging surface extending outwardly from the reduced diameter portion to abut one end of the hollow shaft, said first section further having fastener means for securing the first section in abutment with the hollow shaft for joint rotation of the hollow shaft and brush shaft;

said second section of said brush shaft having an end plate at a first end thereof and a threaded portion at the opposite end thereof with a nut threaded thereon; and a plurality of brushes, each of said brushes including a hub and bristles extending radially outward from said hub, said hub having an aperture therethrough permitting the brushes to be slidable along the second section of said brush shaft between the end plate and said nut, the bristles being of nylon impregnated with silicone carbide abrasive, the brushes being mounted on the second section of said brush shaft for rotation therewith and defining a generally conical brush assembly for cleaning the sloping sides of the form upon rotation of the drive shaft, the brushes being moveable along the second section of the brush shaft in the direction the sides slope inwardly to permit worn brushes to maintain effective cleaning contact with the sides of the form, thereby requiring only replacement of sufficient individual brushes to maintain an effective cleaning contact along the sides of the form.

12. The cleaning apparatus of claim 11 wherein the second section of said brush shaft has a circular cross section and the aperture through each of the hubs of the brushes is circular, said cleaning apparatus further comprising annular rubber members for placement between each of said hubs on the brush shaft so that said nut can be rotated to compress the hubs and rubber members together to ensure joint rotation of the brushes and brush shaft.

13. The cleaning apparatus of claim 11 wherein the second section of said brush shaft has a noncircular cross section, the opening in said hubs also being a noncircular cross section to ensure joint rotation between the brushes and the brush shaft.

14. The cleaning apparatus of claim 11 wherein said drive shaft of said engine mounts a drive clutch, said cleaning apparatus further having intermediate shaft rotatably mounted on said frame for rotation about a third axis parallel to but spaced from said first and second axes, said intermediate shaft mounting a driven unit, said drive clutch and driven unit being interconnected for rotation by a drive belt, said drive clutch, driven belt and drive belt forming a torque converter assembly for efficiently transferring power from the engine to the brush shaft, said intermediate shaft rotating said hollow shaft through a second drive belt.

* * * * *